US005689788A

United States Patent [19]

Moser

[11] Patent Number: 5,689,788

[45] Date of Patent: Nov. 18, 1997

[54] HEAT AND PRESSURE ROLL FUSER WITH SUBSTANTIALLY UNIFORM VELOCITY

[75] Inventor: Rabin Moser, Victor, N.Y.

[73] Assignee: Xerox Corporation, Stamford

[21] Appl. No.: 620,640

[22] Filed: Mar. 22, 1996

[51] Int. Cl.[6] ..... G03G 15/20

[52] U.S. Cl. ..... 399/328; 219/216; 399/68; 492/27

[58] Field of Search ..... 355/282, 285, 355/290, 295; 219/216, 469–471; 432/60; 118/60; 492/27; 399/67, 68, 320, 322, 328, 330, 331, 333, 335

[56] References Cited

U.S. PATENT DOCUMENTS

| | | | |
|---|---|---|---|
| 3,884,623 | 5/1975 | Slack | 432/60 |
| 3,999,038 | 12/1976 | Sikes, Jr. et al. | 432/60 |
| 4,008,955 | 2/1977 | Bar-on | 355/284 |
| 4,042,804 | 8/1977 | Moser | 219/216 |
| 4,107,830 | 8/1978 | Thomson | 492/27 X |
| 4,540,267 | 9/1985 | Moser | 355/290 |
| 4,594,068 | 6/1986 | Bardutzky et al. | 432/60 |
| 4,870,731 | 10/1989 | Yano | 492/16 |
| 5,130,754 | 7/1992 | Hishikawa | 355/282 |
| 5,195,430 | 3/1993 | Rise | 355/295 X |
| 5,209,997 | 5/1993 | Fromm et al. | 355/290 X |

FOREIGN PATENT DOCUMENTS

| | | | |
|---|---|---|---|
| 1-169475 | 7/1989 | Japan | 355/295 |
| 1-185579 | 7/1989 | Japan | 355/285 |

*Primary Examiner*—S. Lee

[57] ABSTRACT

A heat and pressure roll fuser is disclosed for fixing powder images to various substrates. Each of the rolls has a deformable outer layer. One of the rollers is crowned such that its center has a larger diameter than its ends. The other roller has a uniform diameter along its entire length. The difference in the center diameter and the end diameters is such that the fuser produces a substantially uniform nip and a uniform nip velocity. A flared pressure roll is provided for controlling the speed of substrate edges to compensate for waviness along the substrate edges, such waviness being due to moisture picked up by the substrates while being stored prior to being used for duplex imaging.

4 Claims, 5 Drawing Sheets

HEAT AND PRESSURE ROLL FUSER WITH SUBSTANTIALLY UNIFORM VELOCITY

BACKGROUND OF THE INVENTION

This invention relates generally to a fuser for use in an electrophotographic printing machine, and more particularly to a roll fuser having a uniform nip velocity.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an abhesive material, such as a silicone rubber or other low surface energy elastomer or, for example, tetrafluoroethylene resin sold by E. I. DuPont De Nemours under the trademark Teflon. The pressure roll contacts the heated fusing roll to form the aforementioned nip through which the image carrying substrates pass. The pressure roll may also be provided with an abhesive coating or layer.

As will be appreciated by those skilled in this art, when the two similarly constructed fuser rolls are subjected to the required nip forming loads the rolls deflect resulting in a nonuniform nip width which during operation results in a nonuniform nip velocity. This inherent deflection in roll fuser systems creates a "wrinkling tendency" which has been addressed heretofore as set forth in the discussion of the following publications:

U.S. Pat. No. 5,209,997 granted to Paul M. Fromm et al on May 11, 1993 discloses a three roll fuser including a fuser roll, pressure roll and a backup roll. The backup roll is crowned and is supported in pressure engagement with the fuser roll to form a first nip while the fuser roll is also supported in contact with the pressure roll. The pressure engagement of the crowned roll with the fuser roll eliminates nonuniform nip loading in wide fusers as well as providing uniform velocity through the fuser roll/pressure roll nip.

U.S. Pat. No. 4,594,068 granted to Bardutzky on Jun. 10, 1986 relates to a roll-fusing apparatus comprising a heated fusing roller and a pressure roller which form a roller gap therebetween. The shape of the non-cylindrical roller core and the coating of the pressure roller makes it possible to fuse the toner images on copy supports which remain free of wrinkles after passing through the roller gap. In addition, duplication of the copy image does not occur up to DIN A1 size copies. The roller core and the coating of the pressure roller, comprise a silicone elastomer coating and a shrunk-on tubing have varying thicknesses over the length of the roller. As a result, the speed of passage of the copy support at the edges of the roller gap is modified, compared with the speed of passage obtained with a pressure roller having a cylindrical roller core and a cylindrical coating.

U.S. Pat. No. 4,540,267 granted to Moser et al on Sep. 10, 1985 discloses a roll-fusing apparatus comprising an internally heated fusing roller and a pressure roller including a coated roller core which has a cylindrical inner surface and an outer surface which is extended to give a saw-toothed or scalloped, repeatedly bent configuration. The coating of the roller core comprises a silicone elastomer which has a cylindrical outer configuration, and the inside of the coating is firmly bonded to the shaped outer surface of the roller core, such that the thickness of the coating varies over the length of the roller. In the roller gap of the roll-fusing apparatus, a passage speed profile is generated which shows a minimum in each of the two external zones of the pressure roller and in the middle of the roller and the maxima of which are located in the boundary surfaces between the central zone and the left-hand and right-hand external zones.

U.S. Pat. No. 4,042,804 granted to Rabin Moser on Aug. 16, 1977 discloses a pressure and heat fusing apparatus for a copier or duplicator apparatus capable of either simplex or duplex operation including a first roll which is heated to a temperature sufficient to fuse toner images onto support material and a second elastomeric roll arranged axially parallel with the first roll to define a nip through which support material bearing toner images is passed. The second roll is constructed such that its ends move the support material faster at the ends of the support material than at the center thereof.

U.S. Pat. No. 3,884,623 granted to William Frederick Slack on May 20, 1975 relates to an arrangement for fusing dry xerographic toner to a paper sheet by passing the sheet between the rollers, at least one of which is heated. The heated roller is tapered along its length in concave configuration, so that the tendency of the paper to wrinkle is substantially eliminated.

U.S. Pat. No. 4,870,731 granted to Akechi Yano on Oct. 3, 1989 discloses a roller comprising a roller surface layer whose diameter progressively diminishes from its central portion toward the opposite ends, and an arched roller shaft for rotatably supporting the roller surface layer, thereby ensuring that the sheeting is subjected to stretching or shrinking without the possibility of permanent set therein.

U.S. Pat. No. 4,803,877 granted to Akechi Yano on Feb. 14, 1989 discloses a pinch apparatus in which a pair of rolls, comprising rollers whose peripheral length decreases from the center portion in the axial direction towards each end disposed on the curved roller shaft rotatably, are arranged oppositely utilizing a flat part throughout the axial direction at an external periphery of the roller. The pinch apparatus feeds out a material being passed through in quantity corresponding to peripheral lengths in each part of the roller. The apparatus also includes an adjusting device which adjusts the shaft angle and roll ascending and descending portions.

U.S. Pat. No. 4,008,955 granted to Ari Bar-on on Feb. 22, 1977 discloses a fusing apparatus in which particles are affixed substantially permanently to a moving sheet of support material. Each portion of the leading marginal region of the sheet of support material is advanced substantially simultaneously between a fuser roll and a backup roll. As the sheet a support material passes between the fuser roll and backup roll, the side marginal regions thereof advance at a greater velocity than the central region. In this manner, a force component substantially normal to the path of movement of the sheet of support material in the plane thereof, is applied thereto preventing wrinkling.

U.S. Pat. No. 3,999,038 granted to Sikes et al. on Dec. 21, 1976 discloses an improved pressure heated fusing apparatus for a copier/duplicator machine capable of simplex and duplex operation wherein the copy sheets make two passes through processing stations including a first roll which is heated to a temperature sufficient to fuse toner images onto paper support sheet material and a second roll made of an elastic material arranged axially parallel with said first roll to define a nip through which the paper support sheet material bearing toner images is passed having a longitudinal cross-sectional shape with a maximum diameter at the ends and a minimum diameter at the center.

U.S. patent application Ser. No. 08/282,589, now abandoned relates to a heat and pressure fuser for fixing powder images to various substrates without imparting wrinkles to the substrate. The fuser utilizes a soft heated fuser roller which is crowned. Crowning of the soft fuser roll is effected either by use of a crowned core with a uniform thickness or a straight core with variable thickness elastomeric layer adhered thereto.

BRIEF SUMMARY OF THE INVENTION

In accordance with the present invention, there is provided a heat and pressure fuser for fixing powder or toner images. The fuser comprises a pair of rollers which are pressure engaged for forming a nip through which substrates carrying toner images are passed. One of the rollers, e.g. the fuser roller is provided with a deformable outer elastomeric layer such as silicone rubber of the type commonly used for roll fusers. The other roller can also have a deformable layer whose thickness can be as large as that on the first roller or it could be as thin as 0.001 inch. When this deformable layer on the other roll is very thin, it could be replaced by an abhesive material such as PFA. The roller with the thicker layer of deformable material is the softer of the two rolls. Thus, when the two rolls are pressure engaged the softer roll is indented by the harder of the two rolls. The roller with the thicker layer of deformable material is fabricated such that it compensates for the deflection of the rolls forming the fuser nip. To enable this compensation, this roll is crowned. In other words, this roller has a larger diameter at its center than at its ends. The effect of the crowning of the softer roll is that when the crowned roll and the harder roll are pressure engaged a uniform nip is created therebetween. However, because the effective circumference of the ends of the roll is less than the center of the roll, a nonuniform nip velocity results causing the ends of the roll to tend to move the paper through the nip at a slower rate than at the center. This situation creates a tendency for the paper to wrinkle.

According to the present invention, the circumference of the deformable layer on the crowned roller is modified to achieve a constant effective circumference through the nip, along the longitudinal axis of the crowned roller. This is accomplished by making the diameter of the ends of the crowned roll slightly greater than that required to compensate for the nonuniform nip caused by roll deflection. While the increase in the diameter of the roll ends alters the uniform nip by approximately 2% such a slight change has a totally imperceptible effect on the substrates to which the toner images are fused. The pressure roll has flared ends. The amount of material added to the pressure roll to provide the flared ends is subtracted from the diameter at the ends of a fuser roll. The flared ends serve to compensate for waviness along the substrate edges, such waviness being due to moisture picked up by the substrates while being stored prior to being used for duplex imaging.

Other features of the present invention will become apparent as the following description proceeds and upon reference to the drawings, in which:

DETAILED DESCRIPTION OF THE PREFERRED EMBODIMENT OF THE INVENTION

Figure 7:
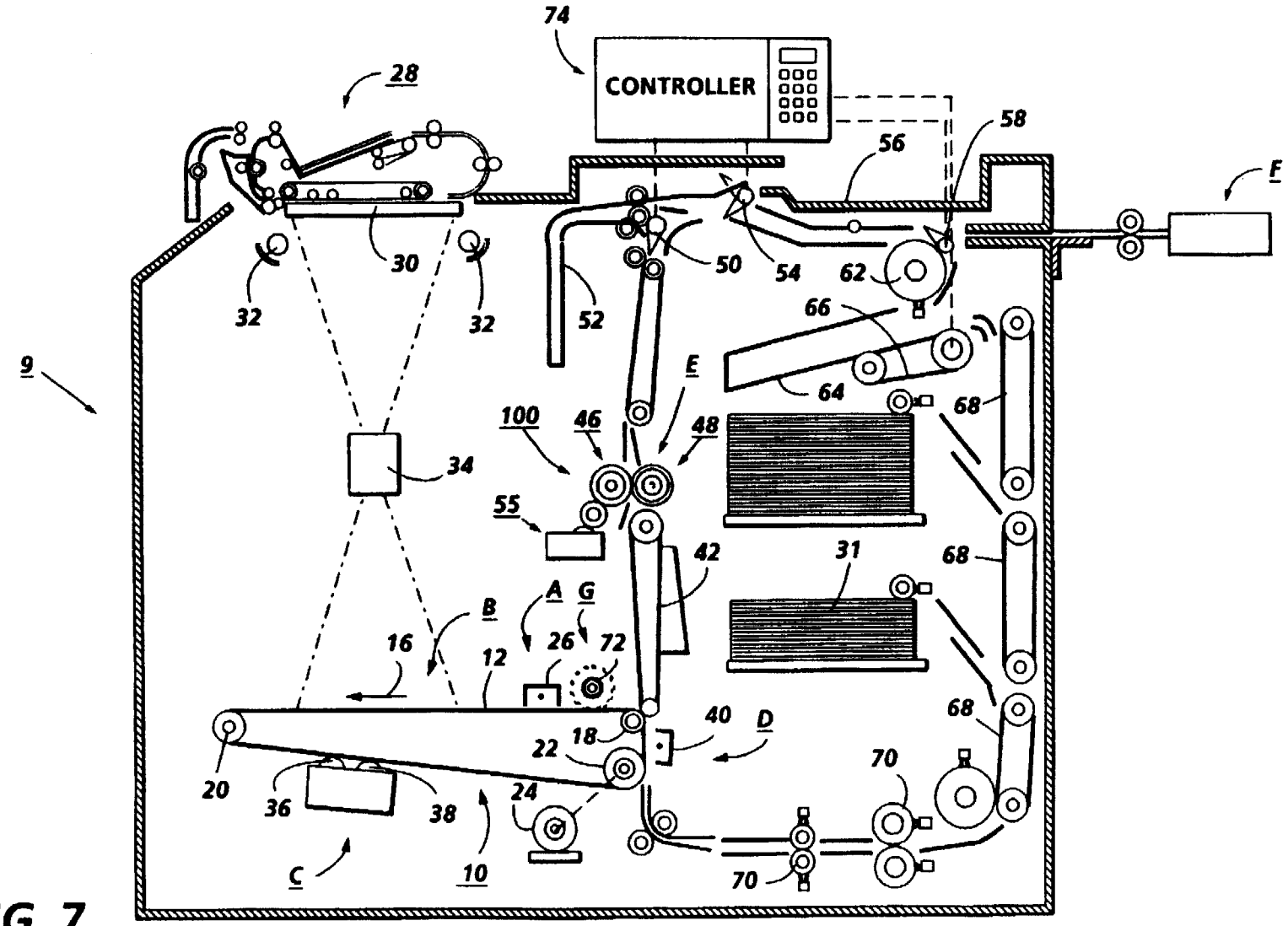
FIG. 7 is a schematic illustration of an imaging apparatus in which the fuser apparatus of the present invention may be utilized.

For a general understanding of the features of the present invention, reference is made to the drawings. In the drawings, like reference numerals have been used throughout to identify identical elements. FIG. 7 schematically depicts an electrophotographic printing machine 9 in which a fuser according to the present invention may be utilized.

Referring to FIG. 7 of the drawings, the electrophotographic printing machine employs a belt 10 having a photoconductive surface 12 deposited on a conductive substrate, not shown. Belt 10 moves in the direction of arrow 16 to advance successive portions of photoconductive surface sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive belt passes through a charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through an imaging station B. At imaging station B, a document handling unit, indicated generally by the reference numeral 28, is positioned over platen 30 of the printing machine. Document handling unit 28 sequentially feeds documents from a stack of documents placed by the operator faceup in a normal forward collated order in a document stacking and holding tray. A document feeder located below the tray forwards the bottom document in the stack to a pair of take-away rollers. The bottom sheet is then fed by the rollers to a feed roll pair and belt. The belt advances the document to platen 30. After imaging, the original document is fed from platen 30 by the belt into a guide and feed roll pair. The document then advances into an inverter mechanism and back to the document stack through the feed roll pair. A position gate is provided to divert the document to the inverter or to the feed roll pair. Imaging of a document is achieved using lamps 32 which illuminate the document on platen 30. Light rays reflected from the document are transmitted through lens 34. Lens 34 focuses light images of the original document onto a uniformly charged portion of photoconductive surface 12 of belt 10 to selectively dissipate the charge thereon. This records an electrostatic latent image on photoconductive surface 12 which corresponds to the informational area contained within the original document. Obviously, electronic imaging of page image information could be facilitated by a printing apparatus utilizing electrical imaging signals. The printing apparatus can be a digital copier including an input device such as a Raster Input Scanner (RIS) and a printer output device such as a Raster Output Scanner (ROS), or, a printer utilizing only a printer output device such as a ROS.

Thereafter, belt 10 advances the electrostatic latent image recorded on photoconductive surface 12 to development station C. At development station C, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

Prior to reaching transfer station D, a copy sheet is placed in proper lateral edge alignment. At transfer station D, a copy sheet 31 is moved into contact with the toner powder image. Transfer station D includes a corona generating device 40 which sprays ions onto the backside of the copy sheet 31. This attracts the toner powder image from photoconductive surface 12. After transfer, conveyor 42 advances the copy sheet to fusing station E.

Fusing station E includes a fuser assembly, indicated generally by the reference numeral 100, which permanently affixes the transferred toner powder image to the copy sheet. Preferably, fuser assembly 100 includes a heated fuser roller 46 and a back-up roller 48 with the powder image on the copy sheet contacting fuser roller 46. The pressure roller is cammed against the fuser roller to provide the necessary pressure to fix the toner powder image to the copy sheet. The fuser roll is internally heated by a quartz lamp.

After fusing, the copy sheets are fed to gate 50 which functions, as an inverter selector. Depending upon the position of gate 50, the copy sheets are deflected to sheet inverter 52 or are fed directly to a second decision gate 54. At gate 54, the sheet is in a faceup orientation with the image side, which has been fused, faceup. If inverter path 52 is selected, the opposite is true, i.e. the last printed side is facedown. Decision gate 54 either deflects the sheet directly into an output tray 56 or deflects the sheet to decision gate 58. Decision gate 58 may divert successive copy sheets to duplex inverter roll 62, or onto a transport path to finishing station F.

At finishing station F, copy sheets are stacked in a compiler tray and attached to one another to form sets. The sheets are attached to one another by either a binding device or a stapling device. In either case, a plurality of sets of documents are formed in finishing station F.

When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side and on which an image will be subsequently printed on the second, opposite side thereof, i.e. the sheets being duplexed. The sheets are stacked in duplex tray facedown on top of one another in the order in which they are copied.

In order to complete duplex copying, the simplex sheets in tray 64 are fed, in seriatim, by bottom feeder 66 from tray 64 back to transfer station D via conveyors 68 and rollers 70 for transfer of the toner powder image to the opposite sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or, when the finishing operation is selected, to be advanced to finishing station F.

Invariably, after the copy sheet is separated from photoconductive surface 12 of belt 10, some residual particles remain adhering thereto. These residual particles are removed from photoconductive surface 12 at cleaning station G. Cleaning station G includes a rotatably mounted fibrous or electrostatic brush 72 in contact with photoconductive surface 12 of belt 10. The particles are removed from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station F.

It is believed that the foregoing description is sufficient for purposes of the present application to illustrate the general operation of an electrophotographic printing machine in which the fuser of the present invention may be utilized.

Figure 1:
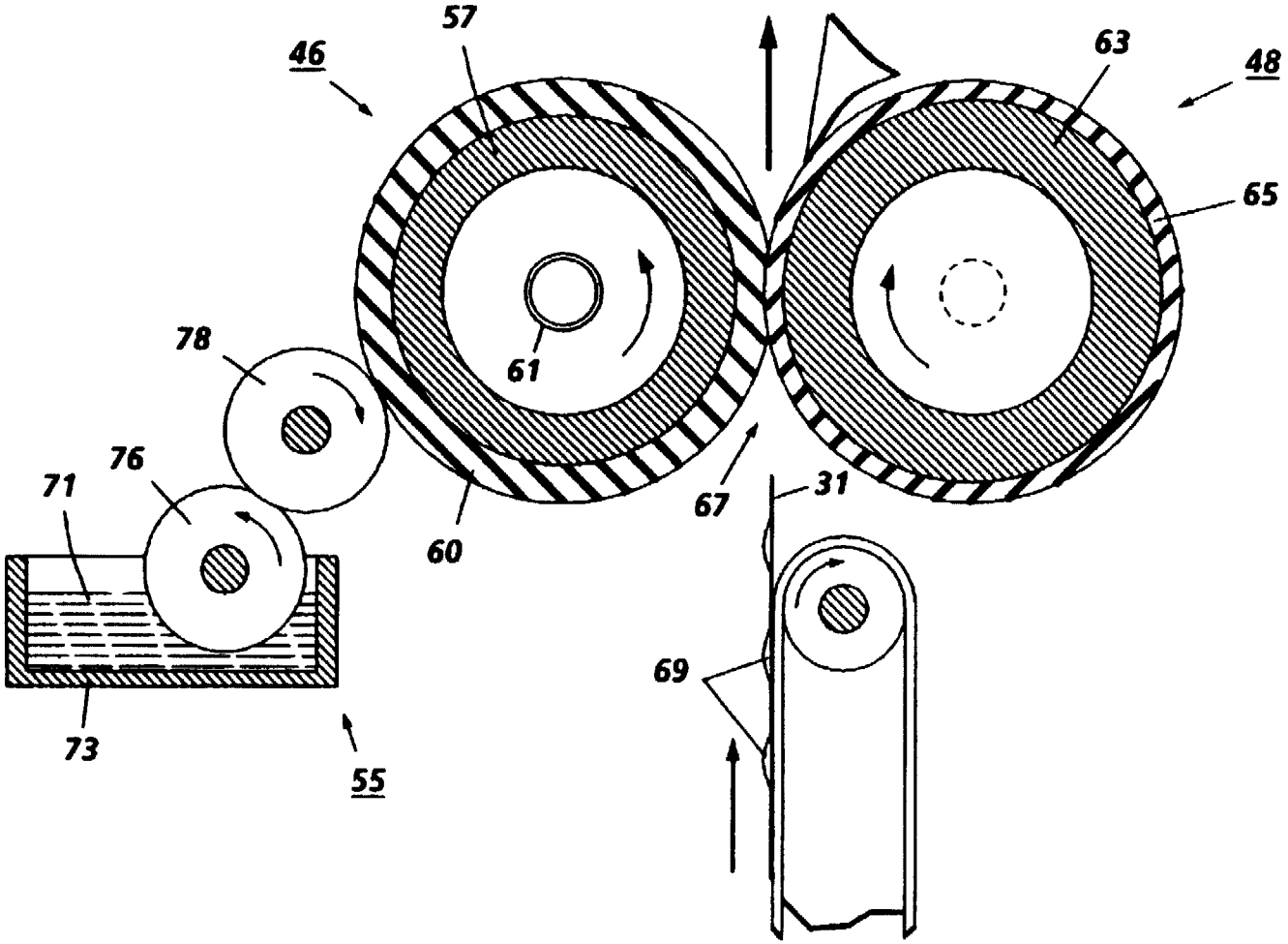
FIG. 1 illustrates a heat and pressure fuser and release agent management system therefor.

Attention is now directed to FIG. 1 wherein the heat and pressure fuser apparatus comprising the fuser roller 46 and pressure roller 48 are illustrated together with a release agent management (RAM) system 55. As shown in FIG. 1, the fuser apparatus comprises the heated fuser roller 46 which comprises a rigid core 57 having coated thereon a relatively thick layer 60 of elastomeric material. The core 57 may be made of various metals such as iron, aluminum, nickel, stainless steel, etc., and various synthetic resins. Aluminum is preferred as the material for the core 57, although this is not critical. The core 57 is hollow and a heating element 61 is positioned inside the hollow core to supply the heat for the fusing operation. Heating elements suitable for this purpose are known in the prior art and may comprise a quartz heater made of a quartz envelope having a tungsten resistance heating element disposed internally thereof. Heating means are well known in the art for providing sufficient heat to fuse the toner to the support. The thick fusing elastomer layer may be fabricated using any well known material such as RTV and HTV silicone rubbers as well as Viton (trademark of E. I. duPont de Nemours & Co.).

The fuser roller 46 is shown in a pressure contact arrangement with the backup or pressure roller 48. The pressure roller 48 comprises a metal core 63 with a layer 65 of a heat-resistant material. In this assembly, both the fuser roller 46 and the pressure roller 48 are mounted on bearings (not shown) which are biased so that the fuser roller 46 and pressure roller 48 are pressed against each other under sufficient pressure to form a nip 67. It is in this nip that the fusing or fixing action takes place. The layer 65 may be fabricated from any well known material such as fluorinated ethylene propylene copolymer or silicone rubber.

The image receiving member or final support 31 having toner images 69 thereon is moved through the nip 67 with the toner images contacting the heated fuser roller 46. The toner material forming the image 69 is prevented from offsetting to the surface of the fuser roller 46 by the application of a release agent material such as silicone oil 71 contained in sump 73.

The sump 73 and silicone oil 71 form part of the RAM system 55. The RAM system 55 comprises a metering roller 76 and a donor roll 78. The metering roller is supported partially immersed in the silicone oil 71 and contacts the donor roll for conveying silicone oil from the sump to the surface of the donor roll 78. The donor roll is rotatably supported in contact with the metering roller 76 and also in contact with the fuser roller 46. While the donor roll is illustrated as contacting the fuser roller, it will be appreciated that, alternately, it may contact the pressure roller 48. Also, the positions of the fuser and pressure rollers may be modified for use in other copiers or printers. A metering blade, not shown, serves to meter silicone oil to the required thickness on the metering roller. For further details of the RAM system 55 reference may be had to U.S. Pat. No. 4,254,732 granted to Rabin Moser.

Figure 2:
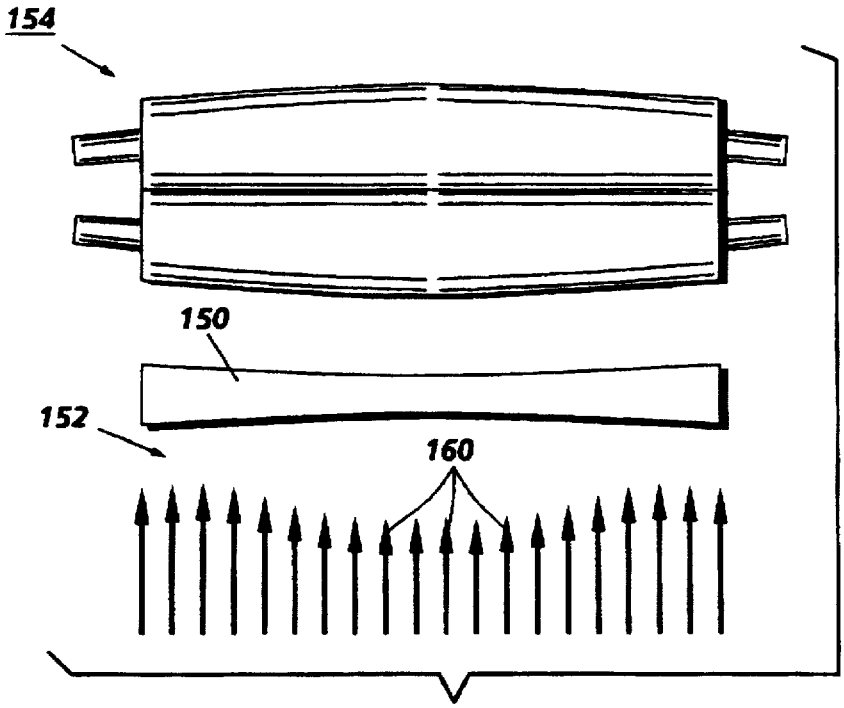
FIG. 2 PRIOR ART
FIG. 2 depicts a conventional roll fuser together with its nip shape and nip velocity profile.

The nip profile or shape 150 and nonuniform nip velocity profile 152 of a conventional nip forming fuser 154 are illustrated in FIG. 2. As shown therein a fuser roller 156 and a pressure roller 158 are deflected as the result of the pressure exerted therebetween when pressure engaged. Such deflection results in the nonuniform nip profile 150 and during operation the nonuniform nip velocity profile 152, indicated by arrows 160. The nonuniform nip velocity tends to cause wrinkling of some substrates. That is to say, that certain substrates will wrinkle while others will not. Usually the lighter weight papers are subject to the wrinkle phenomena.

Figure 3:
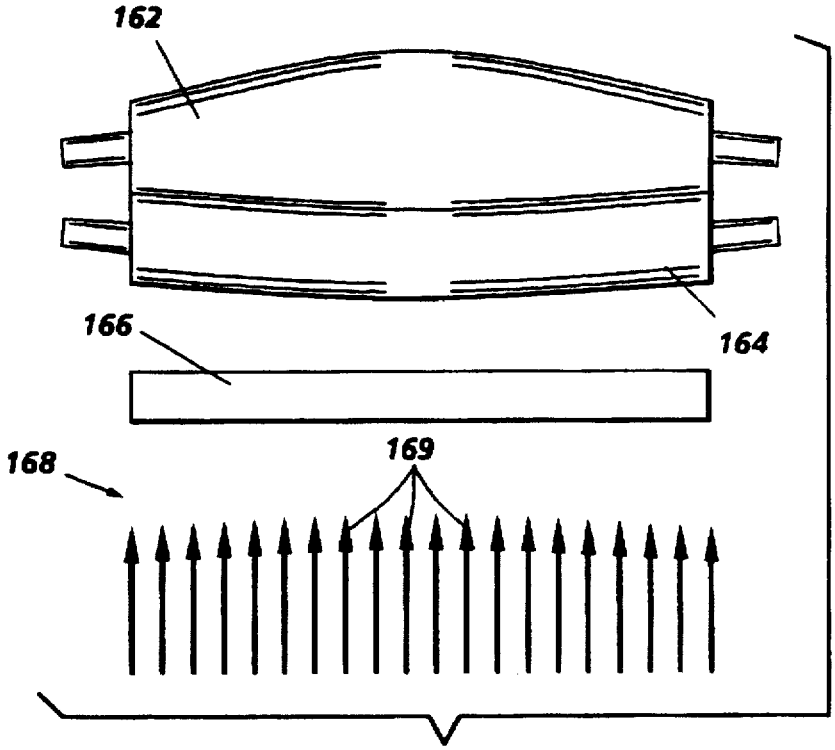
FIG. 3 PRIOR ART
FIG. 3 depicts the nip shape and velocity profile and fuser wherein the inherent nonuniform nip due to roll deflection of a conventional roll fuser is compensated for using a crowned roller.
Figure 4:
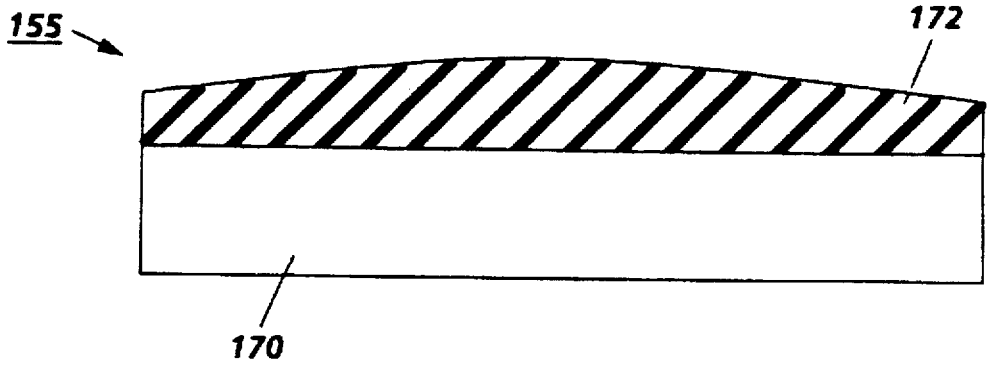
FIG. 4 is a partial cross sectional view of a crowned pressure roller.

Attempts at solving the foregoing problems discussed with reference to FIG. 2 have led to the use of a crowned (i.e. center of roll has a larger diameter than its ends) fuser roll 162 with a uniform diameter pressure roller 164 such as disclosed in FIG. 3. The crowning of a fuser roll 155 can be achieved either by using a cylindrical core 170 having a uniform diameter which is overcoated with a rubber layer 172 that has a nonuniform thickness (FIG. 4) or using a crowned core overcoated with a rubber layer having a uniform thickness. Regardless of the method used for producing the crowned fuser roll, the resulting roll has, for example, a diameter approximately equal to 3.002 inches at its center and a diameter equal to 3.000 inches at each of its ends. While a substantially uniform nip 166 results from such an arrangement the nip velocity is not uniform as illustrated by the nip velocity profile 168 depicted by the arrows 169 is nonuniform. The nonuniform nip velocity stems from the fact that the effective circumference of the the crowned pressure roll varies along the longitudinal axis thereof due to the fact that there is more rubber at the center of the roll than at its ends resulting in a tendency for substrates to move through the nip at a slower rate near the roll ends than at its center.

Figure 5:
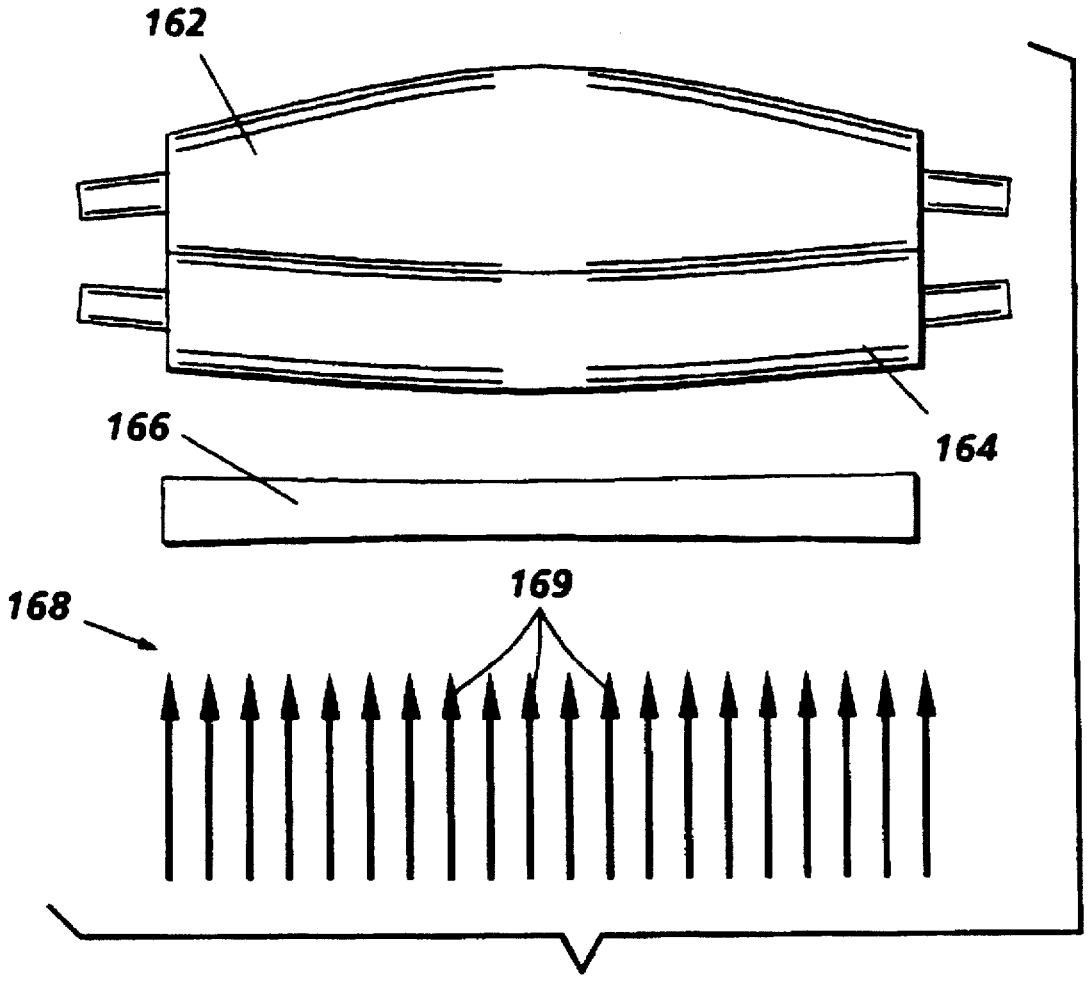
FIG. 5 depicts the nip shape and velocity profile and a roll fuser including a crowned pressure roll.

I have discovered that making the diameters of the ends of a crowned fuser roll 161 (FIG. 5) slightly larger than that required to produce a perfectly uniform nip will yield a slightly nonuniform nip profile 165 while producing the desired effective fuser roll circumference across the entire length thereof resulting in a uniform nip velocity 167 as indicated by 169. The slightly nonuniform nip has an imperceptible effect on the substrates moved through the nip. When used in combination with a straight (e.g. nonuniform diameter) pressure roll 163 an improved NFFR fuser is provided which produces flat substrates. In other words, imaged substrates are produced without wrinkles. By way of example, the crowned fuser roll 161 has a diameter at its center equal to 3.002 inches and a diameter at each of its ends equal to 3.0002 inches.

Sometimes when creating duplex images the substrates are temporarily stored before forming images on the second side. If substrates having simplex images thereon are stored in a high humidity environment their edges become scalloped or wavy. This is due to the differential absorption of moisture at or near the edges of the substrate due to the high humidity atmosphere. It is desirable to have a roll fuser which is capable of handling substrates in this condition, particularly where the high humidity conditions are ever present.

As is well known in the art, flared pressure rolls are provided for controlling the speed of substrate edges to compensate for the waviness along the edges. I have discovered that in order for a flared pressure roll, as described above, to work satisfactorily with a crowned fuser roll of the type described in FIG. 5 the amount of flare added to the harder pressure roll in order to compensate for the waviness must be subtracted from the softer crowned fuser roll in a corresponding location. Thus, the subtractions from the fuser roll are complimentary to the additions to the fuser.

Figure 6:
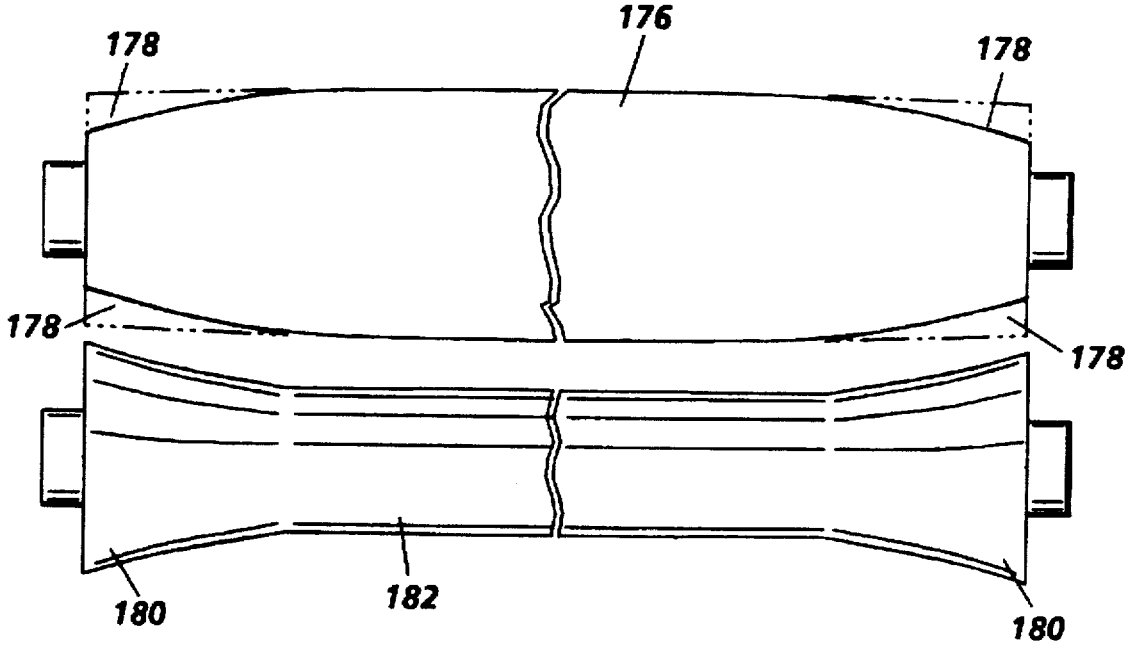
FIG. 6 depicts a roll fuser including a soft roll and hard roll according to the invention.

A roll fuser incorporating all of the novel features recited above is depicted in FIG. 6. As shown therein, the roll fuser device comprises a crowned fuser roll 176 and a flared pressure roll 182. The crowned roller has a diameter equal to 3.002 inches at its center while the diameter at each of its ends is in the range of 2.9982 to 2.9962 inches. The pressure roll 182 has flared ends as indicated by reference character 180. The amount of flare is in the order of 0.002 to 0.004 inch. The amount of material added to the pressure roll to provide the foregoing flare in this embodiment is subtracted from the diameter at the ends as indicated by reference character 178 of a fuser roll such as roll 161 resulting in the fuser roll 176 having end diameters in the range of 2.9982 to 2.9962 inches.

I claim:

1. Fuser apparatus for fixing toner images to various substrates, said apparatus comprising:

a pair of roller members each comprising an outer deformable elastomeric layer;

one of said roller members having a nonuniform diameter such that its center has a larger diameter than its ends;

another of said roller members having flared ends;

said ends of said one of said roller members having a dimension that produces a substantially uniform nip profile and a uniform nip velocity when moved in pressure engagement with said another of said roller members, said ends of said one of said roller members including a thickness equivalent to an amount of flare on said another of said roller members.

2. Fuser apparatus according to claim 1 wherein said one of said roller members comprises a core having a uniform diameter and wherein an elastomeric layer thereon has a nonuniform thickness, said elastomeric layer having a larger diameter at its center than at its ends.

3. Fuser apparatus according to claim 2 wherein said larger diameter is approximately 3.002 inches and wherein said ends have a diameter in the order of 2.9982 to 2.9962 inches.

4. Fuser apparatus according to claim 3 wherein said flared ends of said another of said roller members are in the order of 0.002 to 0.004 inches greater in diameter than the center thereof.

* * * * *